United States Patent [19]

Boich

[11] Patent Number: 4,999,080

[45] Date of Patent: Mar. 12, 1991

[54] APPARATUS FOR PRODUCING A NONWOVEN FABRIC FROM CONTINUOUS FILAMENTS

[75] Inventor: Heinz-H. Boich, Peine, Fed. Rep. of Germany

[73] Assignee: Corovin GmbH, Peine, Fed. Rep. of Germany

[21] Appl. No.: 357,731

[22] Filed: May 26, 1989

[30] Foreign Application Priority Data

May 27, 1988 [DE] Fed. Rep. of Germany ..... 3818033

[51] Int. Cl.[5] ..... D04H 3/00; D04H 3/04

[52] U.S. Cl. ..... 156/441; 156/167; 156/181; 156/433; 425/72.2; 425/83.1

[58] Field of Search ..... 156/441, 167, 181, 296, 156/433; 264/518, 108; 425/72.2, 66, 83.1, 81.1

[56] References Cited

U.S. PATENT DOCUMENTS

| | | | |
|---|---|---|---|
| 3,010,865 | 11/1961 | Porter | 156/167 |
| 3,051,602 | 8/1962 | Schairbaum | 156/167 X |
| 3,379,811 | 4/1968 | Hartmann et al. | 425/72.2 X |
| 3,459,613 | 8/1969 | Copenhefer et al. | 156/167 |
| 3,526,557 | 9/1970 | Taylor, Jr. | 156/167 |
| 3,565,729 | 2/1971 | Hartman | 156/441 |
| 3,579,403 | 5/1971 | Stroop | 156/167 X |
| 3,720,361 | 3/1973 | Nommensen | 226/7 |
| 3,929,542 | 12/1975 | Gehrig et al. | 156/167 |
| 4,496,508 | 1/1985 | Hartmann et al. | 264/518 X |
| 4,753,698 | 6/1988 | Hartmann et al. | 156/167 |

FOREIGN PATENT DOCUMENTS

| | | | |
|---|---|---|---|
| 2163795 | 7/1973 | Fed. Rep. of Germany | 156/167 |
| 1347178 | 11/1962 | France | 156/167 |
| 482903 | 1/1973 | Japan | 156/167 |

*Primary Examiner*—Michael W. Ball
*Assistant Examiner*—Jeff H. Aftergut
*Attorney, Agent, or Firm*—Cushman, Darby & Cushman

[57] ABSTRACT

An apparatus for producing a nonwoven fabric from continuous filaments, which are drawn off at a high speed in the form of a tow, under the influence of a gaseous propellant, from spinnerets of spinning plates of a spinning beam and after passing through a filament draw-off apparatus are laid down by means of a delivery apparatus, embodied as a spreader, on a delivery belt moving in the production direction. In the production direction, two spinning beams are disposed spaced apart from one another, and at least one spinning beam is rotatable, together with the delivery and spreading apparatus, in a plane extending parallel to the delivery belt. A varied pattern of laying down of the nonwoven fabric, or a new nonwoven product, can thus be produced during ongoing operation.

10 Claims, 3 Drawing Sheets

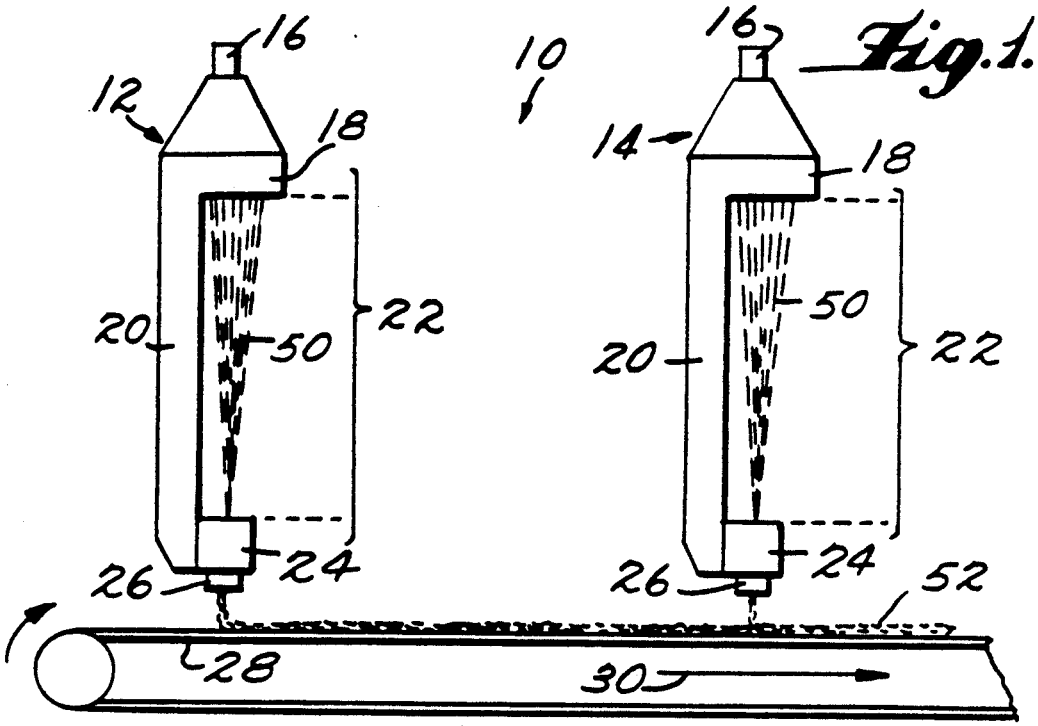
Fig. 1.
Fig. 2.
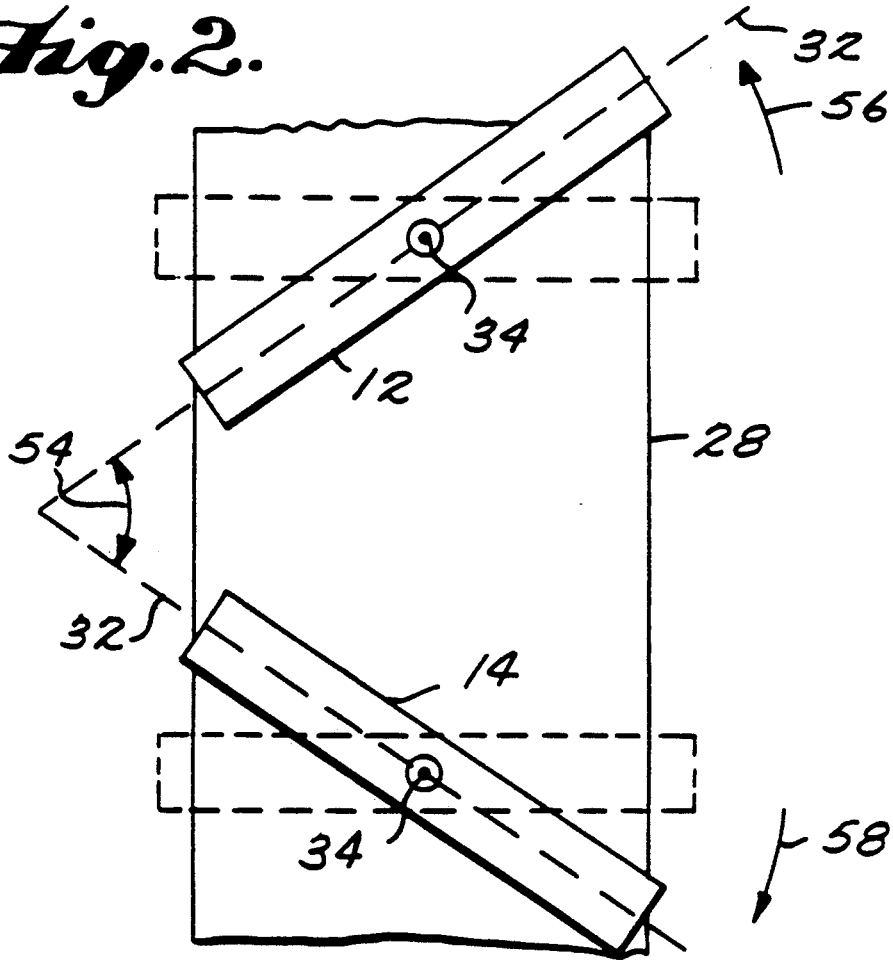

APPARATUS FOR PRODUCING A NONWOVEN FABRIC FROM CONTINUOUS FILAMENTS

FIELD OF INVENTION

The invention relates to an apparatus for producing a nonwoven fabric from continuous filaments as well as to a multiple-ply nonwoven fabric produced from continuous filaments.

BACKGROUND OF THE INVENTION

Apparatus for producing a nonwoven fabric from continuous filaments is already known from German Patent 17 85 158 and British Patents 1,282,176 and 1,297,582. In such apparatus, a tow of filaments is drawn from a liquefied composition from spinnerets with the aid of a gaseous propellant, and the individual filaments are laid down on an apron, in the form of a belt, to form the nonwoven.

A significant characteristic in terms of the quality of nonwovens is their uniformity and strength; the strength, defined as the ratios of the strengths in the longitudinal direction and in the transverse direction, is determined substantially by the angle at which the individual filaments are laid down—that is, the delivery direction with respect to the production direction.

It is already conventional to use spinning beams (or die manifolds) with a multiplicity of individual draw-off tubes for the filaments, with one separator associated with each draw-off tube. The task of the separator is to separate the filaments from the propellant air and at the same time to spread apart the filament bundle. This spreading at the same time defines the delivery angle. When separators are used, allowance must be made in practice for the fact that the various separators have a major influence on one another, because of the emerging propellant air. Accordingly, there is only one favorable setting for the separators, and it can be selected only once, and thus necessarily defines the delivery direction. Hence there only a very limited opportunity exists for attaining different delivery angles.

If a slight change in the angular position of the various separators should in fact be desirable, in order to enable different delivery angles, then the entire apparatus must first be shut off, because changes of this kind cannot be done during ongoing operation of a system. Moreover, changing the delivery angle is associated with considerable amounts of rejection in the nonwoven fabric produced.

It has also already been proposed to provide two spinning beams, with separators spaced apart from one another in the production direction, and with each spinning beam having its own delivery direction for the filaments. The result is so-called crosswise delivery, with two respectively predetermined delivery angles.

As noted above, the various separators affect one another because of the emerging propellant air, so that work can only be done with one favorable setting of the separators that is to be selected once, so that the delivery direction is necessarily predetermined. Thus in this version having two spinning beams, still only limited delivery directions in crosswise delivery can be attained. Moreover, to change the delivery angle, the entire apparatus must first be shut off, with the attendant disadvantages already mentioned.

A need exists in the industry for different strengths in different directions, depending on the intended use of the nonwoven, and this need cannot be met with the previously proposed version having two spinning beams.

In another apparatus for producing a nonwoven fabric from continuous filaments, the so-called curtain method has also already been used. This method dispenses with the many drawoff tubes mentioned above; nor is any spreader (separators) used. The tow, which forms a curtain of large surface area, extends at right angles to the production direction; that is, the preferential delivery direction is parallel to the production direction.

Because of the speed of the filaments, which here is higher in every case relative to the speed of the delivery belt, the delivered filaments move in a serpentine or wavy pattern. In certain regions, individual filaments come to be stacked one on the other.

Although a nonwoven fabric produced with such an apparatus does have a preferred strength in the longitudinal direction, that is, in the production direction, its strength in the transverse direction is extremely poor.

SUMMARY OF THE INVENTION

The object of the invention is to devise an apparatus which permits the production of a nonwoven fabric of high uniformity, and which makes it possible to attain predetermined strength and stretching values of the nonwoven fabric in desired directions. This object is attained by the present invention by apparatus wherein at least two spinning beams are provided spaced apart from one another in the production direction, characterized in that at least one spinning beam together with the delivery and spreading apparatus, is embodied as rotatable in a plane extending parallel to the delivery belt.

Because of the adjustability of at least one spinning beam, the delivery angle can be adjusted to arbitrary values, and a particular advantage is that such an adjustment can be done during ongoing operation of the apparatus.

Delivery angles between 0° and 45°, and vice versa, that is, from 0° to −45°, are preferred, so that the delivery directions of the filaments of the first spinning beam and of the second spinning beam form an angle with one another of less than or equal to 90°, resulting in a variable crosswise delivery.

A nonwoven fabric produced with the apparatus according to the invention may have both isotropic properties and preferential longitudinal strength. Preferential transverse strength is also possible, without impairing the uniformity of the nonwoven fabric, depending on the selection of the delivery angle.

The invention is also intended to produce a multiple-ply nonwoven fabric produced from continuous filaments, which has selectable strength values and high uniformity. This object is attained by providing a multiple-ply nonwoven fabric produced from continuous filaments, characterized in that the delivery directions of the filaments of the individual plies are adjustable to selectable values.

Suitable embodiments and advantageous further features of the invention are disclosed in the dependent claims and in the ensuing description, as well as being shown in the drawing.

The invention will now be described in further detail in terms of the exemplary embodiment shown in the drawings.

BRIEF DESCRIPTION OF THE DRAWINGS

FIG. 1 is a schematic side view of an apparatus heaving two spinning beams;

FIG. 2 is a plan view on the apparatus of FIG. 1;

DESCRIPTION OF THE PREFERRED EMBODIMENT

Figure 3:
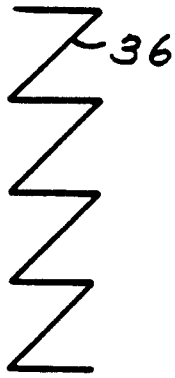
FIGS. 3–5 show various delivery angles.

FIG. 1 shows a spinning station, identified overall by reference numeral 10, which includes two spinning beams (or, also termed, die manifolds) 12 and 14 disposed spaced apart from one another in the transport direction (production direction) 30. A liquefied spinning composition is carried to the spinning plates 18 via liquefied-composition lines 16.

Each spinning plate 18 serves to distribute the liquefied composition over the production width, that is, the width of an apron or delivery belt 28. The spinning plates 18 are attached interchangeably in the lowermost part of the spinning beams 12, 14. A variable number of holes, known as spinnerets, are provided in the spinning plate 18, and through them the liquid spinning composition emerges from the spinning plate 18 in the form of a tow 50 in the manner of a curtain. The tow 50 moves along a blower wall 20, which forms a stretching zone 22 for stretching the tow.

The spinning station 10 also includes one filament draw-off device 24 and one delivery apparatus 26 for each of the two spinning beams 12, 14, by means of which devices the filaments are spread apart to attain high uniformity and laid down on the delivery belt 28, which is moved in the transport direction 30, to form a nonwoven fabric 52.

The curtain method used here accordingly operates with a spreader—comparable to the known separators—to attain a predetermined delivery direction of the filaments, namely a 90° direction with respect to the spinning beam. The filaments are accordingly moved oscillatingly back and forth at 90° with respect to the spinning beam.

As FIG. 1 shows, the delivery takes place first at the spinning beam 12, and onto the thus-formed first layer, a second layer is laid down at the other spinning beam 14, resulting in the production of a multiple-ply nonwoven fabric 52.

Figure 4:
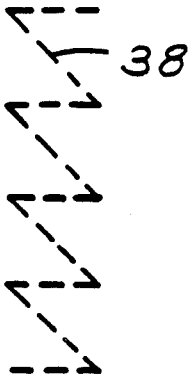
Figure 5:
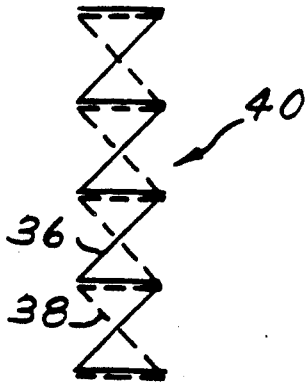

From the plan view of FIG. 2, it can be seen that the spinning beams 12, 14 are pivotable out of their position shown in dashed lines, extending parallel to one another, in the direction of the arrows 56 and 58 about their pivot shafts 34; the longitudinal axes 32 of the spinning beams 12, 14 here form an angle 54. The individual plies of the nonwoven 52 accordingly have the different delivery directions or angles predetermined by the spinning beams 12 and 14. These different delivery directions are shown in FIGS. 3–5. FIG. 3 shows the delivery course 36 of the one spinning beam 12, while FIG. 4 shows the delivery course 38 of the other spinning beam 14. The resultant delivery pattern 40 in the multiple-ply nonwoven 53, which is produced by the superposition of the delivery courses 36 and 38, is shown in FIG. 5. As can be seen there, the individual delivery courses intersect, so that the overall result for the multiple-ply nonwoven is a crosswise delivery with variable angles. When the intersecting delivery courses 36 and 38 in the delivery pattern 40 form an angle of 90° at the intersections, the result is an isotropic nonwoven 52 with identical strength values in all directions.

Figure 6:
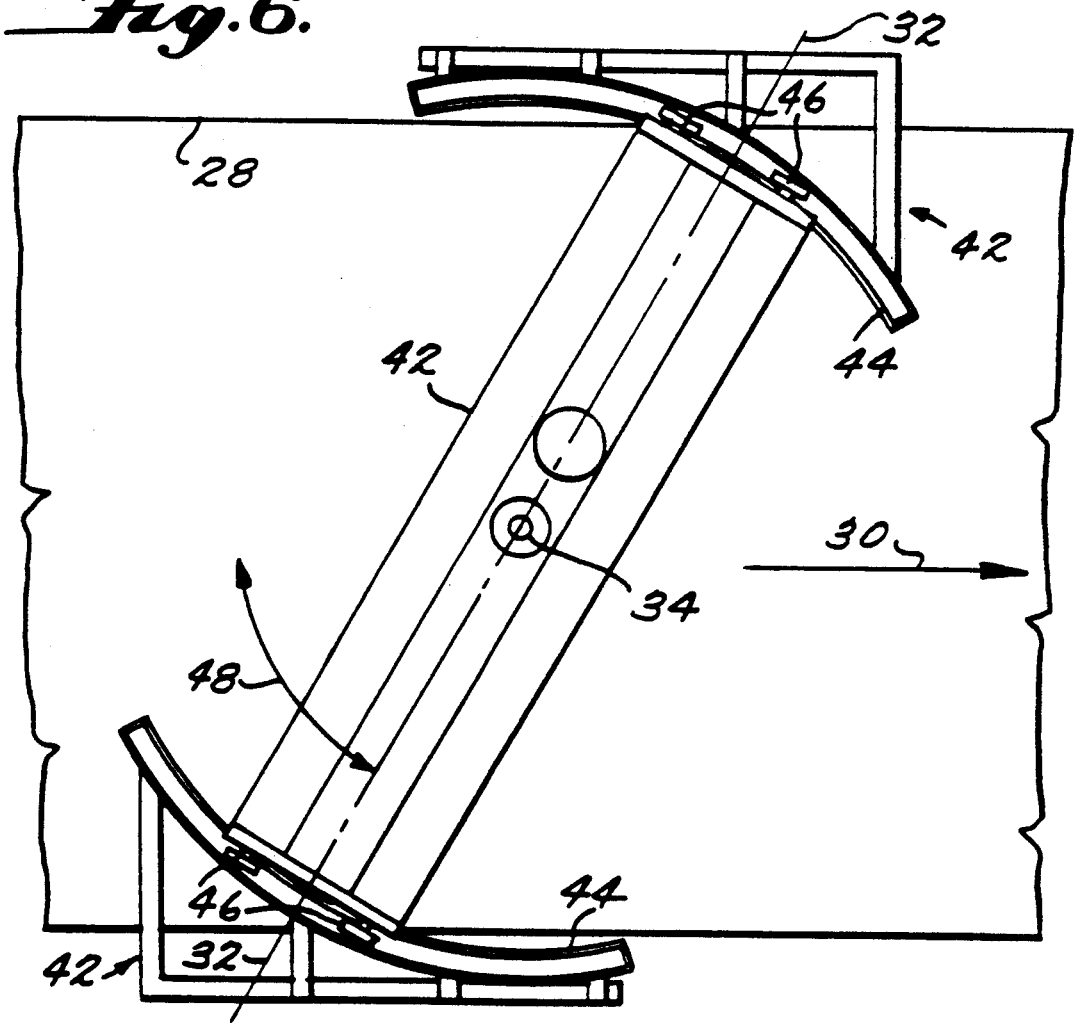
FIG. 6 is a more-detailed plan view on a spinning beam.

Part of the structure of a spinning station 10 is shown in further detail in FIG. 6, which shows the spinning beam 12 in a plan view. Like the spinning beam 14, the spinning beam 12 is disposed on a rotary frame 42 and is retained and guided by means of the guide rollers 46 along circular guide rails 44. The guide rails 44 enable a rotation of the spinning beam 12 about the central pivot shaft 34, so that different rotational angles 48 can be attained. By suitably orienting the two spinning beams 12 and 14, it is accordingly possible to attain different delivery courses 36 and 38 (see FIGS. 3 and 4). This makes it possible for the nonwoven 52 that is produced to be provided with the strength values appropriate for its later use.

Figure 7:
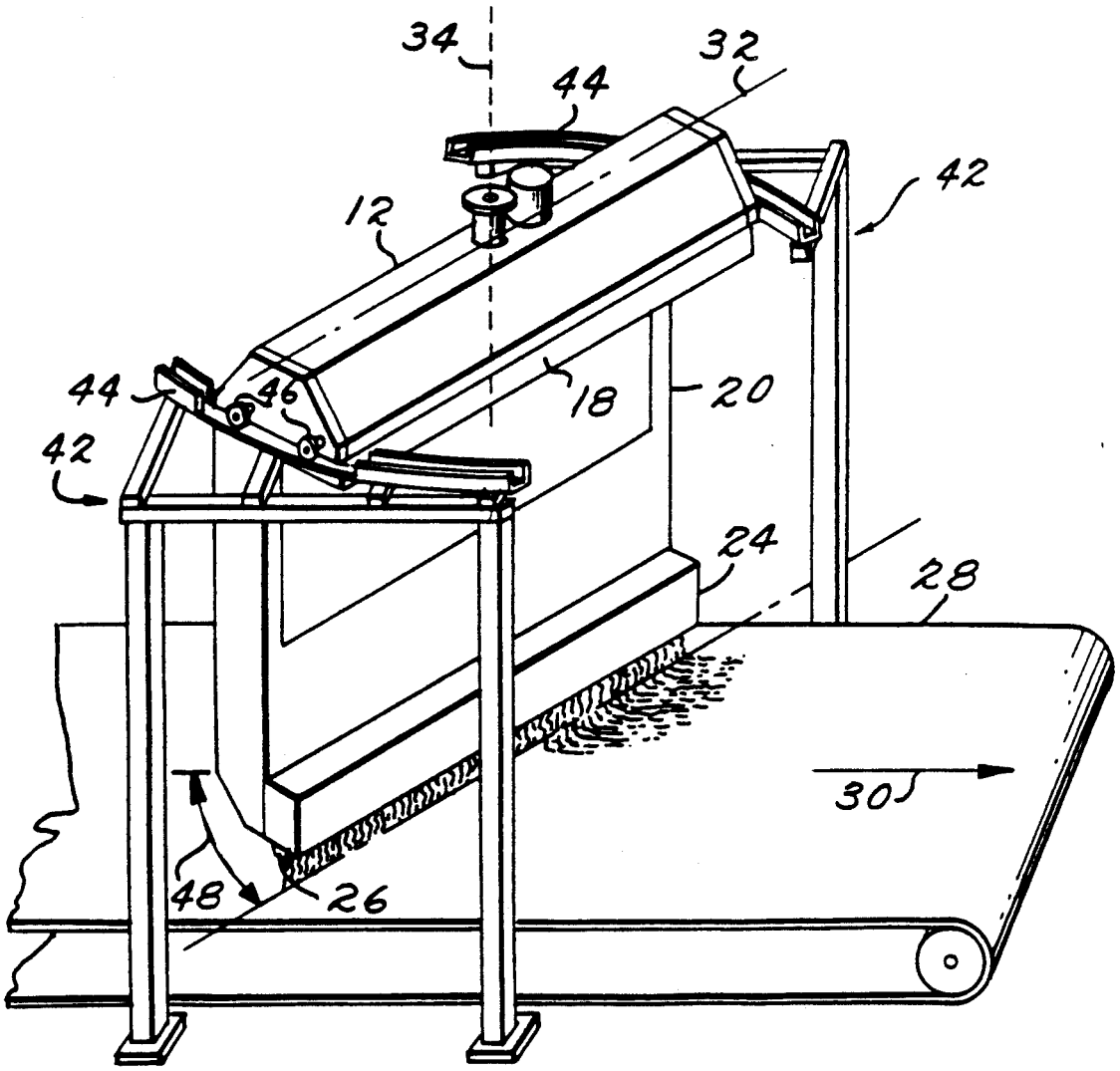
FIG. 7 is a perspective view of a spinning beam of FIG. 6.

Guidance and retention of the spinning beam 12 on the guide rails 44 is also shown in detail in the perspective view of FIG. 7, and it should be stressed that it is also possible to set different rotational angles 48 during ongoing operation of the entire spinning station 10. This is a considerable advantage in the industry, because then it becomes unnecessary to shut off the spinning station and keep it shut down for the setting of new desired rotational angles 48 and thus for generating new delivery patterns 40.

In summary, the spinning station 10 can accordingly be operated in variable fashion, because during ongoing operation of the spinning station a crosswise delivery with variable angles can be attained. Accordingly, a desired new nonwoven product can be produced immediately, during ongoing operation.

What is claimed is:

1. An apparatus for producing a nonwoven fabric from continuous filaments comprising:

(*a*) a delivery belt (28) moving in a production direction (30);

(*b*) first and second spinning beams (12, 14) provided spaced apart form one another in the production direction (30), each spinning beam comprising a spinning plate having spinnerets and further comprising a filament draw-off apparatus (24) and a delivery apparatus (26) embodied as a spreader, at least one of said spinning beam (12, 14) together with the delivery apparatus (26), being rotatable (56, 58) in a plane extending parallel to the delivery belt;

whereby continuous filaments are drawn off under an influence of a gaseous propellant at high speed in a form of a tow (50) from said spinnerets and after passing through said filament draw-off device apparatus (24) are laid down by means of said delivery apparatus (26) on said delivery belt (28) for forming a nonwoven fabric.

2. An apparatus as defined by claim 1, characterized in that said at least one spinning beam (12, 14) is rotatable by an angle of 45°.

3. An apparatus as defined by claim 2, characterized in that at least two spinning beams (12, 14) having longitudinal axes (32) together with the delivery apparatus are rotatable in a plane extending parallel to the delivery belt and that a direction of rotation of the spinning beams (12, 14) is selected such that the longitudinal axes (32) in respective end positions form a maximum angle of 90°.

4. An apparatus as defined by claim 3, characterized in that said at least two spinning beams (12, 14) having outer ends are supported on their outer ends on guide rails (44) extending in a circle.

5. An apparatus as defined by claim 2, characterized in that said at least one spinning beam (12, 14) is rotatable about a central axis (34) located in a middle portion of said at least one beam.

6. An apparatus as defined by claim 5, characterized in that said at least one spinning beam 12, 14) can be locked in desired rotational or angular positions.

7. The apparatus as defined by claim 1, wherein each of said first and second spinning beams (12, 14) is rotatable (56, 58) in a plane extending parallel to the delivery belt.

8. The apparatus as defined by claim 7, wherein each of said spreaders functions to attain a predetermined delivery direction of the filaments.

9. The apparatus as defined by claim 8, wherein said predetermined delivery direction is substantially 90° with respect to the spinning beam.

10. The apparatus as defined by claim 7, wherein each of said first and second spinning beams is rotatable about a central axis (34) located in a middle portion of the spinning beam.

* * * * *